US006668609B2

(12) United States Patent
Schoch

(10) Patent No.: US 6,668,609 B2
(45) Date of Patent: Dec. 30, 2003

(54) PRESS AND VIBRATION SEVERITY DIE CERTIFICATION SYSTEM

(75) Inventor: Daniel A. Schoch, Minster, OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 10/108,772

(22) Filed: Mar. 28, 2002

(65) Prior Publication Data

US 2002/0152782 A1 Oct. 24, 2002

Related U.S. Application Data

(60) Provisional application No. 60/280,000, filed on Mar. 30, 2001.

(51) Int. Cl.[7] ..... B21J 5/00

(52) U.S. Cl. ..... 72/15.1; 100/99

(58) Field of Search ..... 72/15.1; 100/99; 700/206

(56) References Cited

U.S. PATENT DOCUMENTS

| | | | | | |
|---|---|---|---|---|---|
| 4,633,720 | A | * | 1/1987 | Dybel et al. | 100/99 |
| 4,723,429 | A | * | 2/1988 | Weber et al. | 100/99 |
| 6,047,579 | A | * | 4/2000 | Schmitz | 72/15.1 |
| 6,122,565 | A | * | 9/2000 | Wenning et al. | 700/206 |

* cited by examiner

*Primary Examiner*—Lowell A. Larson
(74) *Attorney, Agent, or Firm*—Randall J. Knuth

(57) ABSTRACT

A press die certification system for certifying a press die including a vibration severity monitor operationally connected to the press die to be certified, the monitor creating output containing vibration severity data and press run speed data. Software is utilized for creating a die certificate and die certificate data, calculated on monitor output data obtained from data memory and from press setup information.

27 Claims, 1 Drawing Sheet

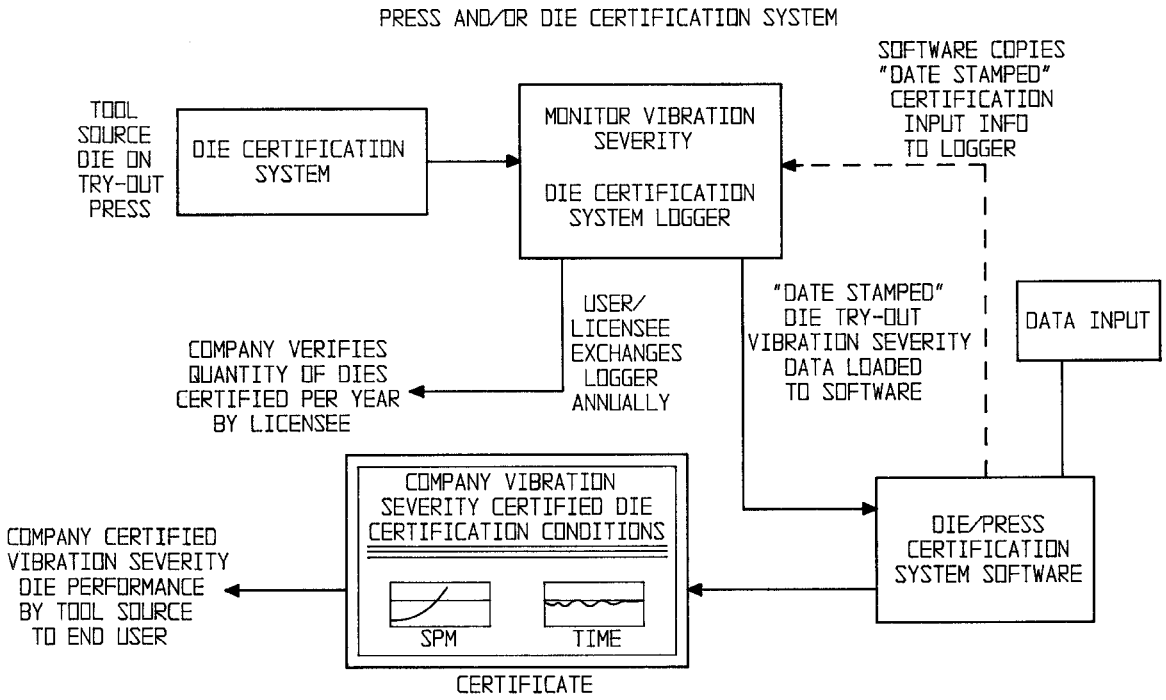

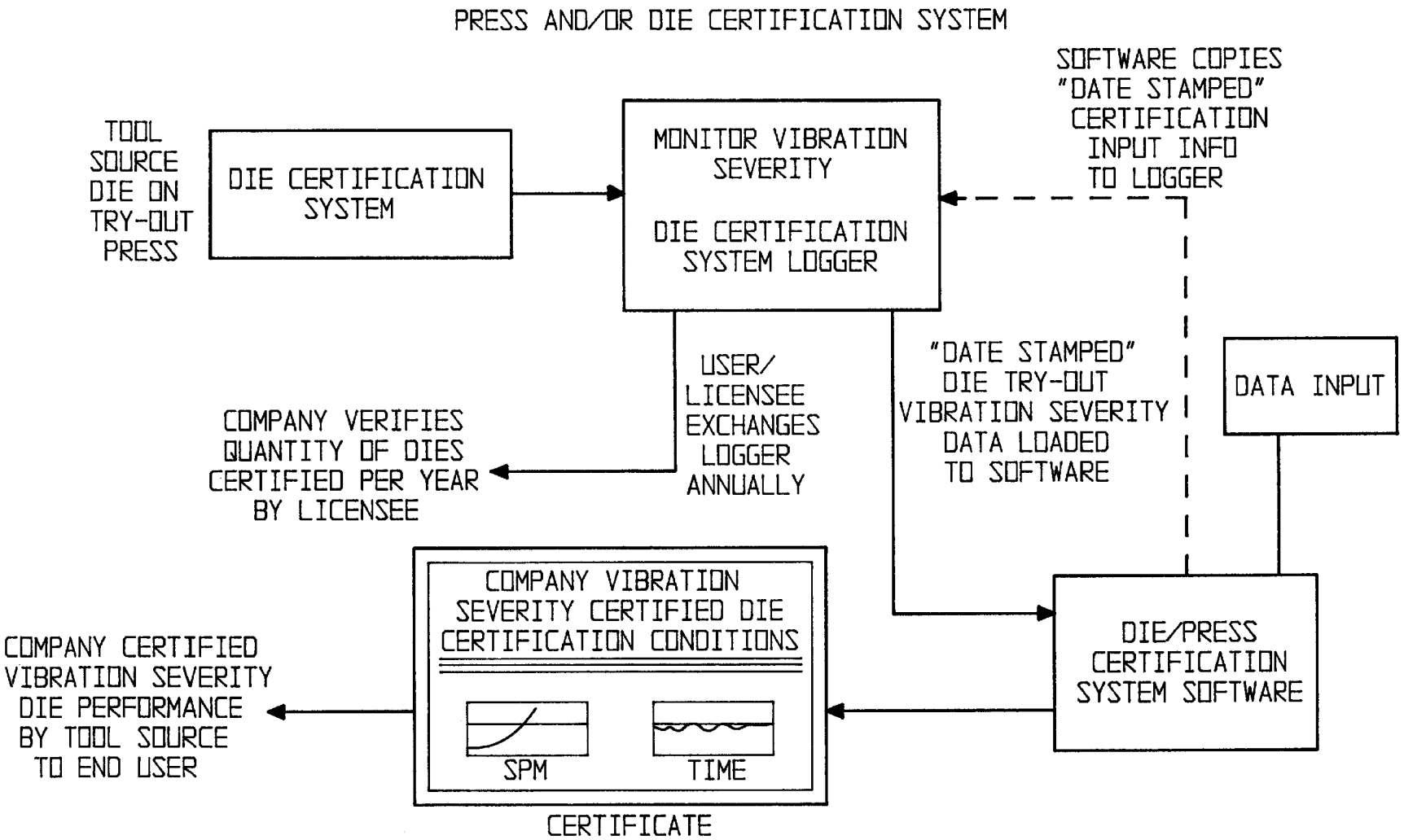
PRESS AND/OR DIE CERTIFICATION SYSTEM
SOFTWARE COPIES "DATE STAMPED" CERTIFICATION INPUT INFO TO LOGGER
DATA INPUT
DIE/PRESS CERTIFICATION SYSTEM SOFTWARE
"DATE STAMPED" DIE TRY-OUT VIBRATION SEVERITY DATA LOADED TO SOFTWARE
MONITOR VIBRATION SEVERITY
DIE CERTIFICATION SYSTEM LOGGER
USER/ LICENSEE EXCHANGES LOGGER ANNUALLY
COMPANY VIBRATION SEVERITY CERTIFIED DIE CERTIFICATION CONDITIONS
TIME
SPM
CERTIFICATE
DIE CERTIFICATION SYSTEM
TOOL SOURCE DIE ON TRY-OUT PRESS
COMPANY VERIFIES QUANTITY OF DIES CERTIFIED PER YEAR BY LICENSEE
COMPANY CERTIFIED VIBRATION SEVERITY DIE PERFORMANCE BY TOOL SOURCE TO END USER

PRESS AND VIBRATION SEVERITY DIE CERTIFICATION SYSTEM

This application claims the benefit of Provisional Application No. 60/280,000, filed Mar. 30, 2001.

BACKGROUND OF THE INVENTION

1. Field of the Invention

The present invention relates to a press monitoring system or press die monitoring system and more particularly, a press die monitoring system that uses vibration severity or other monitored press or press die performance data to enable a die manufacturer or a press manufacturer to certify via a certificate, the press or press die performance to an end user.

2. Description of the Related Art

Presently, press manufacturers and operators have a need to understand how their press machines and associated press dies, used in stamping and drawing operations, will operate in a production environment.

Periodic visits by the tool, die, or machine manufacturer are not sufficient to gain information on how the press machine or die is operating on a daily basis. Furthermore, it would be beneficial to obtain detailed information how a press and/or press die would operate prior to use in the field. There is a concern and use for further information on the intended use of the die, tool, press or machine by the customer and manufacturer for other reasons.

Excessive warranty repair is sometimes developed on misuse of such machines. It would be beneficial to identify proper use of such machines, furthermore identifying potential problems before they lead to an effect on production efficiencies.

What is needed in the art, is a machine certification system that would certify either one or both press or press die, thereby certifying consistent, approved and recommended use, or limitations of use of the press or press die or machine in a production setting.

SUMMARY OF THE INVENTION

The present invention provides a system and method of certifying a machine, such as a press or press die used for stamping or drawing operations. The certification system monitors functions and parameters of the press or press die separate from the actual press controls, therefore the system may be adapted to presses for many different manufacturers. The present invention incorporates a philosophy of monitoring the press and press die and controlling the data thereby developed so as not to tie into the machine operation either mechanically or electrically. Therefore, the present system does not disturb the machine setup or machine control. The system may utilize different press control outputs such as press run speed, load levels, tipping moments, vibration severity zones, and variations in press bottom dead center slide measurement.

The present invention utilizes, in one aspect, vibration severity information from a test run setup of the die to be certified in a tryout press, with date stamped information sent to a die certification system logger (non volatile electronic memory).

A software system then utilizes the data saved within the system logger to determine whether a vibration severity certificate may be issued for such press or press die based on other inputted requirements. Other certificates may be created dependant on operator input and end user requirements.

One advantage of the present invention is that it incorporates a plurality of monitoring criteria, which may be user selectable.

Another advantage of the present invention is that it may permit variable data logging schemes to be utilized depending upon an operator command. This includes the ability to reconfigure data logging dependent on particular time periods, selectable alarms, or other different parameters as shown in a software configuration file.

The invention, in one form thereof, provides a press die certification system for certifying a press die, said system comprising of a vibration severity monitor operationally connected to the press die to be certified, said monitor creating output containing vibration severity data and press run speed data. A data input means is utilized for entering press setup information. A press die data memory means is utilized for saving said monitor output. A software means is utilized for creating a die certificate and die certificate data calculated on said monitor output data obtained from data memory means and from said press setup information.

The invention, in another form thereof, comprises a press die certification method including the steps of: operating a press die at various speeds and conditions and thereby creating press die performance data; saving said created press performance die data; transferring said saved press die performance data to the certification software; inputting at least one of die setup and press run condition data into the certification software; creating a press die certification document through the use of certification software utilizing the saved press die performance data and inputted data.

The invention, in anther form thereof, comprises a press die certification system for certifying a press die, said system comprising: a press die performance monitor operationally connected to the press die to be certified, said monitor creating output containing press die performance data and press run speed data; data input means for entering press setup information; a press die data memory means for saving press die performance data, press setup information and time stamp information, said data memory means accepting input from said press die performance monitor and said data input means; and software means for creating a die certification document and die certification data based on data obtained from data memory means and data input means and comparison of performance level to pre-determined acceptable/non-acceptable performance criteria levels.

The invention, in yet another form therefore, comprises a press certification system for certifying a press, said system comprising: a press performance monitor operationally connected to the press to be certified, said monitor creating output containing press performance data and press run speed data; data input means for entering press setup information; a press data memory means for saving press performance data, press setup information and time stamp information, said data memory means accepting input from said press performance monitor and said data input means; software means for creating a pressd certification document and press certification data based on data obtained from data memory means and data input means and comparison of performance level to pre-determined acceptable/non-acceptable performance criteria levels. In a broader alternative, the system could be coupled to almost any machine with aspects to be monitored, saved, verified and certified.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 1 is a functional flowchart of one form of the present invention.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

One limited embodiment shown in FIG. 1, discloses the functionality and hardware apparatus of the present invention. The embodiment disclosed in FIG. 1 may be utilized, in its preferred form of that of a press die certification system. Alternate utilization of the technology measurement system, memory, and software may be for certifying a mechanical device such as a machine press. Other machine devices may be similarly certified in similar fashion.

The die certification system as shown uses a die certification monitor, and particularly in one form of a vibration severity monitor which identifies the vibration level of the tool (die) that is being run in a tryout press. Associated with that data is data from the running of the press; the data is transferred and saved into a tamper resistant or tamper evident electronic logger. The system then during the die tryout period is logs (saves to memory) data into the die certification system logger. Other data from such as in situ die measurement, press tool, or press performance monitor operationally connected to the press or press die may forward other performance data to the system logger. Such information may include press die performance data, press run speed data, vibration severity zone levels, tipping moment severity zone levels, load severity, historical vibration severity versus time accumulation levels and variations in press or machine bottom dead center slide or other measurements, along with other particular variables that may end up ultimately being needed to be certified for the particular tool, die or press.

The die certification system logger may be a memory means, such as an electronic memory device, for saving the data. The data saved in the die certification system logger, or memory device, is utilized in the die/press certification system software at a latter time period. The software means, such as coded in any of known computer languages for use in a microprocessor, is used for when creating a die certification document and die certification data based on the data obtained from the data memory means, i.e. the die certification system logger, and data input means.

The present system software is preferably programmed through a C++ object oriented language and operated on a IBM compatible, personal computer, such as a 486 or PENTIUM based microprocessor. Other types of electronic processors and computer languages may be equivalently utilized. Standard programming and electronic organizational procedures would enable one of ordinary skill to develop the software to communicate between the hardware utilized.

In the present invention, the processor may be that of a hardened personal computer, such as a IBM compatible 486 or PENTIUM based programmable computer. Additionally, such electronic processor 20 may include hardware or software configured programmable logic controllers (PLC's) and numerous other types of electronic computation and processing equipment.

The system software is connected to a data input means which may be useful for an operator to enter in press setup information and other particular pieces of information necessary to be attached to a certified die or placed into the certification document created by the software. Such information may include a die number, manufacturing tool source, customer for the tool or print specifications. Other data available for entry into the software could be utilization of stock feed material thickness, stock feed material type, die operating shutheight, and die kiss block clearance at bottom dead center slide settings.

The software will print out a die tool or press certification document based on data obtained from the data memory input means along with a comparison of a performance level to a predetermined acceptable or non-acceptable performance criteria level. Such predetermined acceptable or non-acceptable performance criterial level may be entered via the data input means.

The press and/or die certification system of the present invention allows a tool source (a maker of tools or dies for use in a mechanical press) the ability to run the die in a tryout machine and understand what the performance of the die is from a vibration severity or other die performance data standard, or load other requirements into the software and create a certificate to transmit either on paper, award, or electronically to the end user of the certified product (ie, die, tool, press or machine).

The present system may certify that a die, tool or press utilized in a tryout situation or in a tryout machine, performed in a particular manner, and that such die, tool or press will operate in a reasonable performance or known performance based on particular criteria such as vibration severity versus speed, vibration severity change over time, tipping moments, permissible load severity levels, and variations in bottom dead center measurement, of the press and/or tool.

In the preferred form of the embodiment as shown in FIG. 1, the system obtains a vibration severity measurement from a die on a tryout press and sends it to a memory device which identifies logs and compiles the information based on running of the tool, die or press through particular speeds and loads. The system creates a certificate which shows the performance of the die, tool or press during the tryout and certifies that die, tool or press for a customer would perform within required limits. The particular limits useful in creating the certificate, or requested limits, may be entered into the system certification software via the data input means which may be a touch screen, keyboard, or other electronic device for entering data into software or hardware.

Another aspect of the system is that the system software useful in creating the die certificate also copies a date stamped certification input back into the info logger to show that the certification system has been run and certificate made for particular inputs. The software which copies the data stamped certification input back into the logger may include the data such as die number, customer, customer number, setup conditions, materials, material type, and other information to enable saving not only of performance data but conditions and exact die information that go along with the date stamped tryout information originally saved.

One aspect of the invention, the die certification system logger useful for dies, tools, and presses would be of a electronic memory chip or other memory means which would be tamper resistant or tamper evident such that the tool source or operators of a system could not erase or change the data so saved therein. The usefulness of this feature allows then the user licensee to exchange or remove the certification system logger electronic memory and forward it back to the die certification system manufacturing company to verify the number of dies certified and to track proper use of the certification system logger and system software by creating an electronic interlock system between the die certification monitor on the tryout press to the die certification system logger, electronic changing or tampering of saved data or creation of false data would be prevented.

The method of the system utilizes software and saved memory to create a certificate which could be required from a end user of the tool, die or press for particular operational needs. The system eliminates the possibility, via a secure manner, of different tool, die and press providers pointing to other vendors equipment as sources of problems. Typically such end users utilize more than one press manufacturer, tool source, or die source. When a problem develops in one or more subsystems in the end users manufacturing stream, such subsystem manufacturers typically blame the other subsystems and the system.

The certification system of the present invention or its parallel use in a press or other machine creates the ability such that when the machine, tool, die, or press has been certified, with a certificate created, such guaranteed usefulness of the machine under the given conditions is assured.

In the present envision of the system, the certificate as shown in FIG. 1 shows that vibration severity was certified on a particular die with particular known running conditions versus vibration severity versus the press speed (strokes per minute) and the vibration severity change over length of time. Such requirements for the certificate may be entered via the data input means and printed on the certificate while the system software confirms that the data logger includes such data that would assure meeting such operational requirements of the end user.

The system utilizes date stamped information since such use ties the data to actual die conditions. The logger during operation grabs and saves the performance data. All the conditions of operation are loaded in the certification software when they are creating the certificate. By taking all such alphanumeric information and transmitting and saving a copy of it to the logger, operator compliance, and the ability to backtrack and recreate the reasons for certification and how the die, tools, or presses were utilized for initial data gathering may be observed.

Although in FIG. 1 the die certification system is shown connected to the die certification system logger, the certification system logger may be a separate independent memory element which may be transferred from a location near the die, tool source, or press, and then moved into communication with the system software via wireless, floppy disk, or other method or transport mechanism for movement of data.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press die certification system for certifying a press die, said system comprising:

a vibration severity monitor operationally connected to the press die to be certified, said monitor creating output containing vibration severity data and press run speed data;

a data input means for entering press setup information;

a press die data memory means for saving said monitor output; and software means for creating a die certificate and die certificate data calculated on said monitor output data obtained from data memory means and from said press setup information.

2. The system of claim 1 in which said press die data memory means is tamper resistant.

3. The system of claim 1 in which said software means outputs die certificate data to said press die data memory means.

4. The system of claim 1 in which said press die data memory means is tamper evident.

5. The system of claim 1 in which said vibration severity data and press run speed data is time stamped on its saving into said memory means.

6. The system of claim 1 in which said press setup information includes at least one of press type, stock feed material thickness, stock feed material type, die operating shutheight, and die kiss block clearance at press bottom dead center slide settings.

7. The system of claim 1 in which said data input means permits an operator to enter at least one die condition for which die certification is sought, said software determining if the die for certifying would operate at such condition and then communicating success or failure of certification at such die condition.

8. The system of claim 7 in which said vibration severity data and press run speed data is time stamped on its saving into said memory means.

9. The system of claim 7 in which said press setup information includes at least one of press type, stock feed material thickness, stock feed material type, die operating shutheight, and die kiss block clearance at press bottom dead center slide settings.

10. A press die certification method comprising the steps of:

operating a press die at various speeds and conditions and thereby creating press die performance data;

saving said created press die performance data to a memory means;

transferring said saved press die performance data to certification software;

inputting at least one of die setup and press run condition data into the certification software;

creating a press die certification document through the use of the certification software utilizing the saved press die performance data and inputted data.

11. The method of claim 10 further comprising saving the press run condition data to said memory means.

12. The method of claim 11 in which said press run condition data includes vibration severity data and press run speed data, said saving step further comprising time stamping said vibration severity data and said press run speed data on its saving into said memory means.

13. The method of claim 10 in which said saving step includes time stamping said press run condition data on its saving into said memory means.

14. The method of claim 10 in which said press run condition data includes vibration severity data and press run speed data, said saving step further comprising time stamping said vibration severity data and said press run speed data on its saving into said memory means.

15. The method of claim 10 in which said press die performance data includes selected die performance criteria measured versus press speed or selected die performance criteria versus time.

16. A press die certification system for certifying a press die, said system comprising:

a press die performance monitor operationally connected to the press die to be certified, said monitor creating output containing press die performance data and press run speed data;

data input means for entering press setup information;

a press die data memory means for saving press die performance data, press setup information and time stamp information, said data memory means accepting input from said press die performance monitor and said data input means;

software means for creating a die certification document and die certification data based on data obtained from data memory means and data input means and comparison of performance level to pre-determined acceptable/non-acceptable performance criteria levels.

17. The system of claim 16 in which said press die data memory means also saves die certification data from said software means.

18. The system of claim 16 in which said press die data memory means is tamper resistant to prevent data alteration.

19. The system of claim 16 in which said press die performance data and press run speed data is time stamped on its saving into said memory means.

20. The system of claim 16 in which said performance criteria levels include at least one of: vibration severity zone levels, tipping moment severity zone levels, load severity levels, historical vibration severity versus time accumulation levels, and variations in press bottom dead center measurement.

21. A press certification system for certifying a press, said system comprising:

a press performance monitor operationally connected to the press to be certified, said monitor creating output containing press performance data and press run speed data;

data input means for entering press setup information;

a press data memory means for saving press performance data, press setup information and time stamp information, said data memory means accepting input from said press performance monitor and said data input means;

software means for creating a press certification document and press certification data based on data obtained from data memory means and data input means and comparison of performance level to pre-determined acceptable/non-acceptable performance criteria levels.

22. The press certification system of claim 21, wherein said press certification document is an assurance of a level of at least one of performance and usefulness of said press under a given set of use conditions.

23. A machine certification system for certifying a machine, said system comprising:

a machine performance monitor operationally connected to the machine to be certified, said monitor creating output containing machine performance data and machine run speed data;

data input means for entering machine setup information;

a machine data memory means for saving machine performance data, machine setup information and time stamp information, said data memory means accepting input from said machine performance monitor and said data input means;

software means for creating a machine certification document and machine certification data based on data obtained from data memory means and data input means and comparison of performance level to pre-determined acceptable/non-acceptable performance criteria levels.

24. The machine certification system of claim 23, wherein said machine certification document is an assurance of a level of at least one of performance and usefulness of said machine under a given set of use conditions.

25. The machine certification system of claim 23, wherein the machine certification system is configured for certifying at least one of a press, a press die, and a press machine.

26. The machine certification system of claim 23, wherein said machine data memory means is at least one of tamper proof and tamper evident.

27. The machine certification system of claim 23, wherein said performance criteria levels include at least one of: vibration severity zone levels, tipping moment severity zone levels, load severity levels, historical vibration severity versus time accumulation levels, and variations in press bottom dead center measurement of a machine press.

* * * * *